US011624483B2

(12) United States Patent
Paylor

(10) Patent No.: US 11,624,483 B2
(45) Date of Patent: Apr. 11, 2023

(54) DECORATIVE LIGHTING PANEL SYSTEM

(71) Applicant: William Paylor, Edmond, OK (US)

(72) Inventor: William Paylor, Edmond, OK (US)

( * ) Notice: Subject to any disclaimer, the term of this patent is extended or adjusted under 35 U.S.C. 154(b) by 0 days.

(21) Appl. No.: 17/522,263

(22) Filed: Nov. 9, 2021

(65) Prior Publication Data

US 2023/0046666 A1 Feb. 16, 2023

Related U.S. Application Data

(60) Provisional application No. 63/232,224, filed on Aug. 12, 2021.

(51) Int. Cl.

| | |
|---|---|
| ***F21K 9/20*** | (2016.01) |
| ***F21V 31/00*** | (2006.01) |
| ***F21V 23/00*** | (2015.01) |
| ***H05B 45/20*** | (2020.01) |
| ***H05B 45/10*** | (2020.01) |
| ***F21Y 105/16*** | (2016.01) |
| ***F21Y 115/15*** | (2016.01) |
| ***F21W 121/00*** | (2006.01) |
| ***F21Y 113/13*** | (2016.01) |

(52) U.S. Cl.

CPC ..... *F21K 9/20* (2016.08); *F21V 23/008* (2013.01); *F21V 31/005* (2013.01); *H05B 45/10* (2020.01); *H05B 45/20* (2020.01); *F21W 2121/004* (2013.01); *F21Y 2105/16* (2016.08); *F21Y 2113/13* (2016.08); *F21Y 2115/15* (2016.08)

(58) Field of Classification Search

CPC ..... F21K 9/20; F21V 23/002; F21V 31/005; H05B 45/20; H05B 45/10

See application file for complete search history.

(56) References Cited

U.S. PATENT DOCUMENTS

| | | | | |
|---|---|---|---|---|
| 10,408,431 | B1 * | 9/2019 | Thurman | F21V 19/003 |
| 2005/0128743 | A1 * | 6/2005 | Chuey | G04G 9/04 362/234 |
| 2012/0026743 | A1 * | 2/2012 | Yasuoka | H05B 45/20 362/382 |
| 2014/0111993 | A1 * | 4/2014 | Bertin | F21V 3/00 362/249.02 |
| 2014/0254197 | A1 * | 9/2014 | Wang | G02B 6/0076 362/612 |
| 2017/0016611 | A1 * | 1/2017 | Hodgson | F21V 17/14 |
| 2017/0108197 | A1 * | 4/2017 | Cacciabeve | F21V 15/01 |

(Continued)

*Primary Examiner* — Bryon T Gyllstrom

(74) *Attorney, Agent, or Firm* — Brennan, Manna & Diamond, LLC

(57) ABSTRACT

The present invention relates to a decorative lighting panel for mounting to a home exterior via mounting holes, brackets, bolts, etc. The panel has a frame that includes a groove between a front surface and rear surface of the panel. A plurality of illumination sources in the form of LED strips or chips are disposed in the groove, for providing illumination and a retractable plastic cover is designed to reveal the LEDs when pulled down. The plastic cover generally covers the LEDs when illumination is not required. The panel has wireless capabilities allowing a remote control or a handheld electronic device with an installed software application to remotely control the operations of the panel. The panel is designed to be electrically connected to other similar panels to form a series of panels for creating a long segment of illumination.

14 Claims, 8 Drawing Sheets

(56) References Cited

U.S. PATENT DOCUMENTS

| | | | | |
|---|---|---|---|---|
| 2017/0122544 | A1* | 5/2017 | Schmitt | E04H 4/148 |
| 2017/0280521 | A1* | 9/2017 | Shan | B60Q 3/53 |
| 2018/0045378 | A1* | 2/2018 | Kiliszewski | F21V 3/02 |
| 2018/0118097 | A1* | 5/2018 | Thompson | F21S 2/005 |

* cited by examiner

DECORATIVE LIGHTING PANEL SYSTEM

CROSS-REFERENCE TO RELATED APPLICATION

The present application claims priority to, and the benefit of, U.S. Provisional Application No. 63/232,224, which was filed on Aug. 12, 2021 and is incorporated herein by reference in its entirety.

FIELD OF THE INVENTION

The present invention relates generally to the field of illumination devices. More specifically, the present invention relates to a decorative light kit comprising a plurality of decorative light panels that can be connected to each other and can be easily mounted to a home exterior during festivals, holidays, or other occasions. The decorative light panel features a groove containing multiple decorative lights and includes a retractable plastic cover that can be pulled down to reveal the lights. Accordingly, this disclosure makes specific reference thereto the present invention. Nonetheless, it is to be appreciated that aspects of the present invention are also equally applicable to other like applications, devices and methods of manufacture.

BACKGROUND

By way of background, illumination devices, such as lamps, lighting strips, string lights, hanging lamps, etc., are often used for decorating a home exterior, office premises and other places during seasonal holidays like Christmas, Halloween, etc. At home, people either decorate themselves or they get decoration assistance from various decoration service providers. However, decorating sometimes requires connecting lighting sources, such as lamps, lighting strips, etc. electrically to provide power to the lighting source and then mounting the lighting sources on a wall or other surface. The mounted lights can be activated during festive or holiday seasons and once the season is over, the lights are removed from the wall. Thus, the complete task of decorative lights can be difficult, frustrating and tiresome.

Also, while mounting the lighting devices, users are required to setup a ladder, and then constantly climb up and down ladders to attach the lights to different areas of a home exterior. While climbing up and down the ladder constantly, users may accidently fall down and may get injured. Further, having decorations put up by external service providers on every festival, holiday and occasion can get expensive for users. Thus, users may be reluctant to hire a decoration service provider, and may want to decorate themselves, thereby leaving users tired.

Additionally, while mounting lighting devices, different kinds of clips are used. The conventional clips used to hang lights can be flimsy and may end up falling during inclement weather. People may desire an improved mounting mechanism for mounting illumination devices on the wall.

Further, while connecting multiple lighting devices, a plurality of wires is used that can easily get tangled and damaged as well. Once the wires are tangled, a lot of time and effort of the user is required to untangle the wires and connect the lighting devices properly. The complete lighting setup with wires can degrade the look of walls and make the home exterior appear unappealing to others. The objective of lighting devices to improve the home exterior fails in such situations.

Therefore, there exists a long felt need in the art for a lighting device that can be used for decorating home exteriors, office premises and more, during festivals or holidays, such as Christmas, Halloween, etc. There is also a long felt need in the art for a lighting device that can be easily mounted to different areas of the home exterior. Additionally, there is a long felt need in the art for an illumination device that eliminates the need to constantly climb up and down ladders to connect and mount multiple lighting devices, and therefore prevents the users from injuries due to accidental falling from ladders. Moreover, there is a long felt need in the art for an illumination device that eliminates the need to remove the mounted lighting devices when the holiday season is over. Further, there is a long felt need in the art for an illumination device that can be mounted easily by the user themselves and does not require assistance from external decoration service providers. Furthermore, there is a long felt need in the art for an illumination device that eliminates the use of conventional clips to hang or mount the lighting devices. Also, there is a long felt need in the art for an illuminating device that eliminates the use of wires for connecting multiple lighting devices and therefore prevents tangling of wires as well. Finally, there is a long felt need in the art for an illuminating device that enhances the overall look of a home's exterior and is appealing to the users.

The subject matter disclosed and claimed herein, in one embodiment thereof, comprises a decorative lighting panel that can be mounted on a wall or other areas during festive or holiday seasons, such as Christmas, Halloween, etc. The decorative lighting panel includes a frame having a front surface, a rear surface and a pair of side edges, a plurality of illumination sources in the form of LED strips disposed within a groove positioned between the front surface and the rear surface of the frame, a LED driver for driving the LED strips and controlling sequencing, color, and intensity of the emitted light. The front surface has a lower portion having a slot, wherein a retractable plastic cover configured for covering the LED strips, is pulled up from the slot to cover the LED strips and is retracted back to reveal the LED strips.

In this manner, the novel decorative lighting panel of the present invention accomplishes all of the forgoing objectives, and provides a relatively easy and convenient solution to decorating a home exterior, office premises, etc., during holiday seasons. The decorative lighting panel of the present invention is also user friendly, as it eliminates the need to remove the lights once the holiday season is over. Also, the panels can be painted to match the color of the walls in order to ensure an aesthetic appealing look to the walls.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a decorative lighting panel. The decorative lighting panel includes a frame having a front surface, a rear surface and a pair of side edges, and a plurality of illumination sources in the form of LED strips disposed within a groove, positioned between the front surface and the rear surface of the frame. Further, the decorative lighting panel comprises a LED driver for driving the LED strips and controlling sequencing, color, and intensity of the emitted light. The front surface has a lower portion having a slot, wherein a retractable plastic cover configured for covering the LED strips is pulled up from the slot to cover the LED strips and is retracted back to reveal the LED strips. The plastic cover is operated using at least one button disposed on the frame for automatic retraction and extension.

In yet another embodiment of the present invention, a remotely-controlled decorative lighting panel for mounting to a wall of a building is disclosed. The lighting panel includes a plurality of LED strips disposed within a frame, a driver circuit having an integrated sequencing circuit for driving and sequencing the LED strips, a Bluetooth chip for establishing a Bluetooth connection with a remote control, wherein the panel receives wireless instructions for one or more of, changing the color, sequencing and intensity of LEDs from the remote control, a retractable cover for covering and revealing the LED strips, wherein the LED strips are automatically activated when the cover is pulled down to reveal the LED strips and are automatically deactivated when the cover is pulled up to cover the LED strips.

In yet another embodiment of the present invention, the Bluetooth connection can be established between the panel and a handheld electronic device, wherein a software application installed in the handheld electronic device remotely controls the LED sources and the panel receives wireless instructions for one or more of, changing the color, sequencing and intensity of the LEDs and pulling up or down the plastic cover.

In yet another embodiment of the present invention, a series of decorating lighting panels for use as permanently installed seasonal lights is disclosed. The series includes a plurality of lighting panels connected to each other in series connection, wherein each panel has a male electrical connector at one edge and a female electrical connector at the other edge, the male electrical connector of a first panel is connected to the female electrical connector of a second panel for a series connection, wherein the first panel precedes the second panel and the panels are controlled using a control box coupled to the series of panels or remotely through a remote control using a Bluetooth wireless channel.

In yet another embodiment, the decorative lighting panel has replaceable LED sources in the form of LED strips or chips that can be replaced and are driven by DC supply, which is converted from AC supply by an LED driver.

In yet another embodiment, a lighting panel having a retractable cover for covering the illumination sources disposed within the panel is disclosed. The lighting panel has a frame, a plurality of illumination sources in the form of LEDs disposed in a groove formed between a rear surface and a front surface of the frame, a retractable cover designed which extends from a lower portion of the front surface to cover the LEDs, when the LEDs are not illuminated and to retract back to reveal the LEDs, when the LEDs are illuminated, and a driver for driving the LEDs. The panel has a male electrical connector and a female electrical connector for making connections with an external AC supply or with other similar panels.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
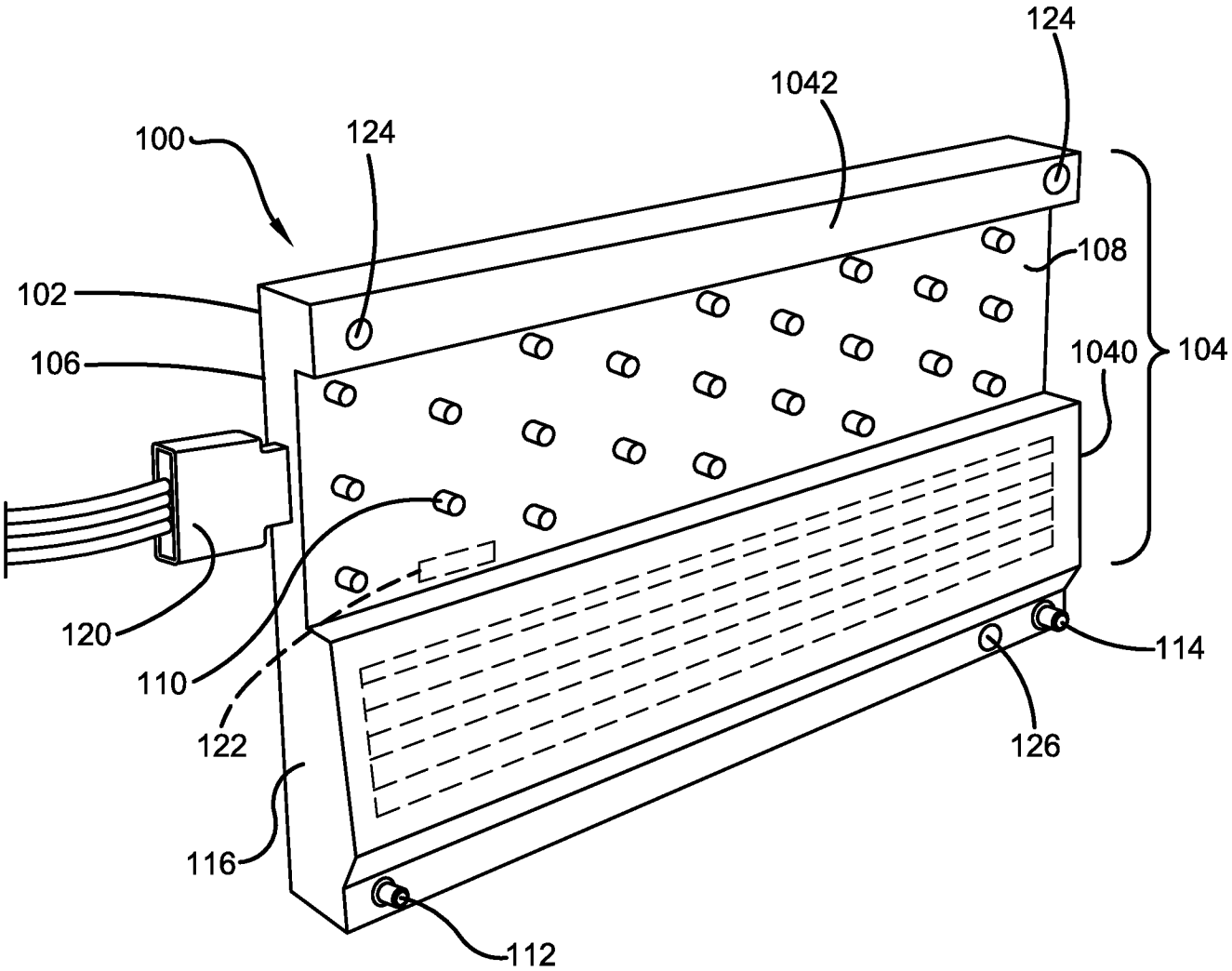
FIG. 1 illustrates a perspective view of one potential embodiment of the decorative lighting panel of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

As noted above, there exists a long felt need in the art for a lighting device that can be used for decorating a home exterior, office premises, etc., during festivals and holidays, such as Christmas, Halloween, etc. There is also a long felt need in the art for a lighting device that can be easily mounted to different areas of the home exterior. Additionally, there is a long felt need in the art for an illumination device that eliminates the need to constantly climb up and down ladders to connect and mount multiple lighting devices on a wall, and therefore prevents users from injuries due to accidental falling from ladders. Moreover, there is a long felt need in the art for an illumination device that eliminates the need to remove the mounted lighting devices when the holiday season is over. Further, there is a long felt need in the art for an illumination device that can be mounted easily by the user, and does not require assistance from an external decoration service provider. Furthermore, there is a long felt need in the art for an illumination device that eliminates the use of conventional clips to hang or mount the lighting devices on the wall. Also, there is a long felt need in the art for an illuminating device that eliminates the use of wires for connecting multiple lighting devices and therefore, prevents tangling of wires as well. Finally, there is a long felt need in the art for an illuminating device that enhances the overall look of a home's exterior and is appealing to users.

The present invention, in one exemplary embodiment, is a novel remotely controlled decorative lighting panel for mounting to a wall of a building. The lighting panel includes a plurality of LED strips disposed within a frame, a driver circuit having an integrated sequencing circuit for driving and sequencing the LED strips, a Bluetooth chip for establishing a Bluetooth connection with a remote control, wherein the panel receives wireless instructions for one or more of, changing the color, sequencing and intensity of the LEDs from the remote control, a retractable cover for covering and revealing the LED strips, wherein the LED strips are automatically activated when the cover is pulled down to reveal the LED strips and are automatically deactivated when the cover is pulled up to cover the LED strips.

Referring initially to the drawings, FIG. 1 illustrates a perspective view of one embodiment of the decorative lighting panel 100 of the present invention. The decorative lighting panel 100 of the present invention is designed to be mounted to a home exterior via mounting holes, brackets, bolts, etc., or any other suitable mounting means as is known in the art, and allows users to maintain their lights year-round and selectively activate them for different occasions, such as, Christmas, Halloween, birthdays, etc., and numerous other suitable special occasions as are known in the art. More specifically, the decorative lighting panel 100 has a weather resistant frame 102 having a plurality of edges. In an example embodiment, the lighting panel 100 is rectangular in shape, though other suitable shapes are also considered as is known in the art. The housing 102 has a front surface 104 and a rear surface 106, wherein the rear surface 106 is planar and adheres to a surface to which the lighting panel 100 is mounted.

Figure 2B:
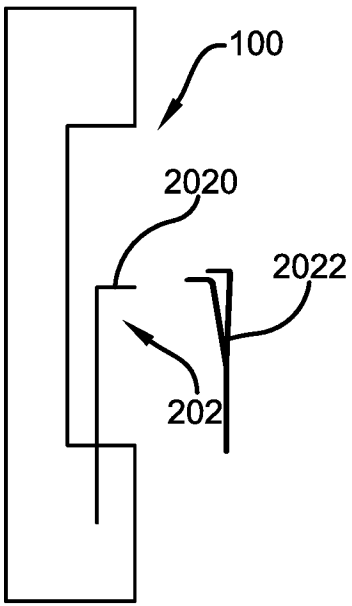
FIG. 2B illustrates a side view showing the retractable plastic cover of one potential embodiment of the decorative lighting panel of the present invention for covering the illumination sources in accordance with the disclosed architecture.
Figure 2A:
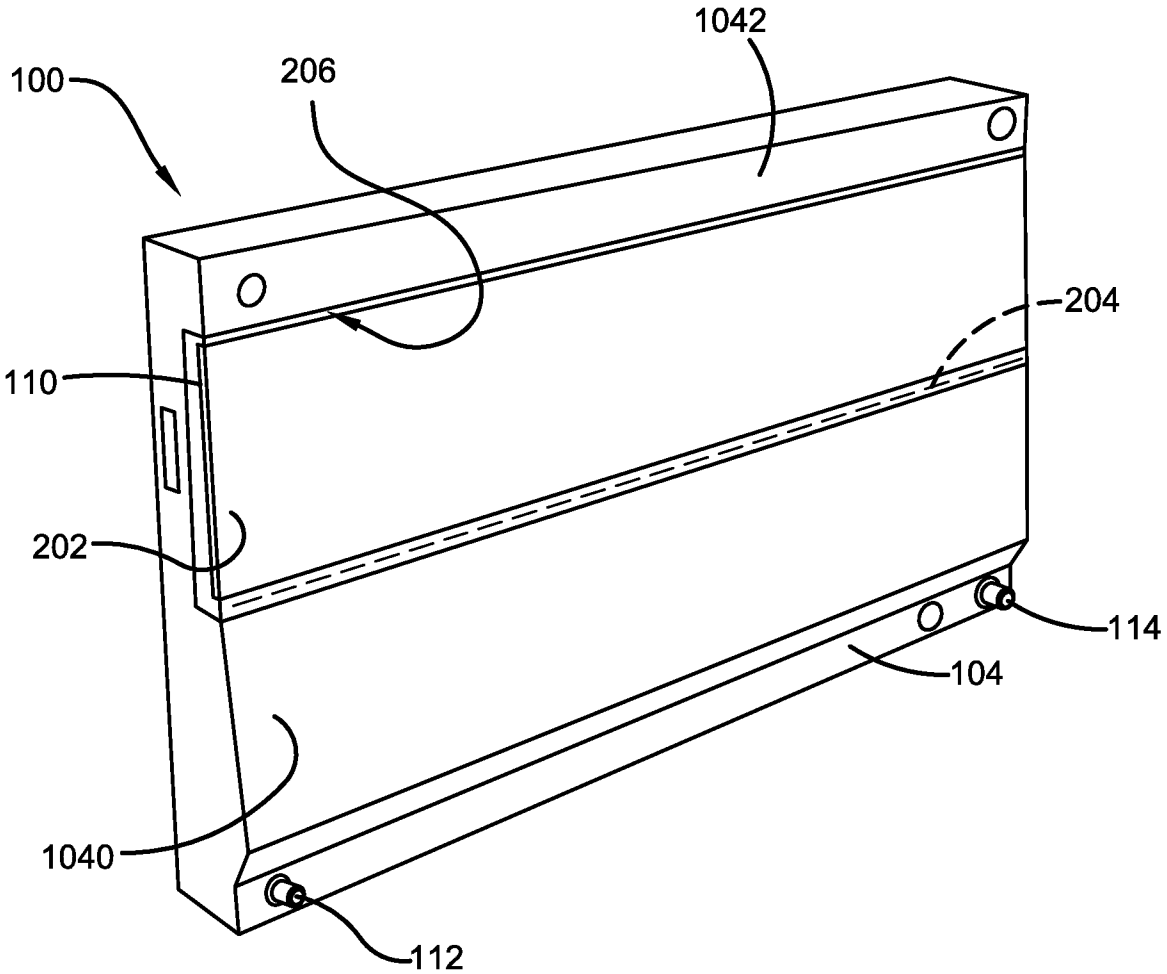
FIG. 2A illustrates a perspective view showing the retractable plastic cover of one potential embodiment of the decorative lighting panel of the present invention for covering the illumination sources in accordance with the disclosed architecture.

Further, a grooved panel 108 exists between the front surface 104 and the rear surface 106 and a plurality of illumination sources 110, in the form of one or more LED chips, LED strips, LED modules, or LED packages are accommodated in the groove 108. The illumination sources 110 are covered by a retractable plastic cover that can be pulled down using the control buttons 112, 114 to visually expose the illumination sources 110 from the outside. The control buttons 112, 114 are disposed on the lower portion 1040 of the front surface 104, such that when pushed, the buttons retract a plastic cover (shown as dashed lines in the present embodiment; 202 in FIG. 2A) to store within the lower portion 1040 of the front surface 104. The retraction of the cover 202 can further be achieved via a small motor 700 that is in electrical communication with the buttons 112,114. In an additional embodiment, the cover 202 may have a lip 2020 that can be engage by a pronged tool 2022 to allow a user to manually open/close the cover 202, as seen in FIG. 2B. In one embodiment, the control buttons 112,114 may also be used to power on/off the panel 100. The details and use of the retractable plastic cover are described in detail in FIG. 2A below.

Each of the side edges 116, 118 of the housing 102 has an electrical connector (120 shown on side edge 116) that allows connection of the lighting panel 100 with other lighting panels and also with an external power supply for illumination. The electrical connectors are used for electrically stacking the panels to each other and are described best in FIG. 3 below.

Each electrical connector 120 is internally connected to a driver circuit 122 that drives the illumination sources 110. The driver circuit 122, preferably a LED driver, is connected to the illumination sources 110 through an internal wired circuit (not shown) and provides electrical power to the illumination sources 110. The driver circuit 122 offers a plurality of lighting sequence and can be controlled to create a desired lighting sequence to accommodate different times of the year, such as Christmas, Halloween, etc. and a plurality of patterns such as but not limited to blinking, chasing, swirling, etc. The driver circuit 122 can have an integrated LED light sequencer or chaser circuit that generates a low frequency oscillation for providing sequencing of the light. The electrical connector 120 forms the entry point of an electric wire into the lighting panel 100 and the LED driver 122, disposed within the housing 102, facilitates coupling with the illumination sources 110. In one embodiment, the circuit 122 can be controlled using a remote controller 406 that is in electrical communication with the circuit 122 and device.

It should be appreciated that the disclosed technology of the present invention provides the light fixture 100 including a frame 102 that provides a substantially flat light emitting diode (LED) panel 110 within the grooved panel 108 disposed within the frame 102 and specifically between the front surface 104 and the rear surface 106. The LED driver 122 is electrically coupled to an external AC power supply via AC input wiring through the electrical connector 120 and electrically coupled to the light emitting diode (LED) panel 110. The LED sources 110 provide bright and uniform light in a plurality of colors. The plurality of LEDs 110 can output various colors and/or color temperatures. For example, the LEDs can include white LEDs having an output of a predetermined color temperature. In accordance with another embodiment, the LEDs 110 can include a plurality of colored LEDs (i.e., LEDs having a red output, a green output, and a blue output). The LED driver 122 can be configured (in one exemplary embodiment, by the control 800) to control the intensity of the light emitted, thereby providing a dimming function.

The LED illumination sources 110 can be in the form of one or more strips of LEDs, where the strip of LEDs are removably coupled allowing for the easy replacement of one or more strips of LEDs. For example, in the case of a LED failure or burnout, the strip of LEDs could be easily replaced without replacing the entire fixture. In addition, the color output of the light fixture could be altered by swapping out one or more of the LED strips. For example, during the Christmas season, white LEDs can be replaced with red LEDs.

Figure 4:
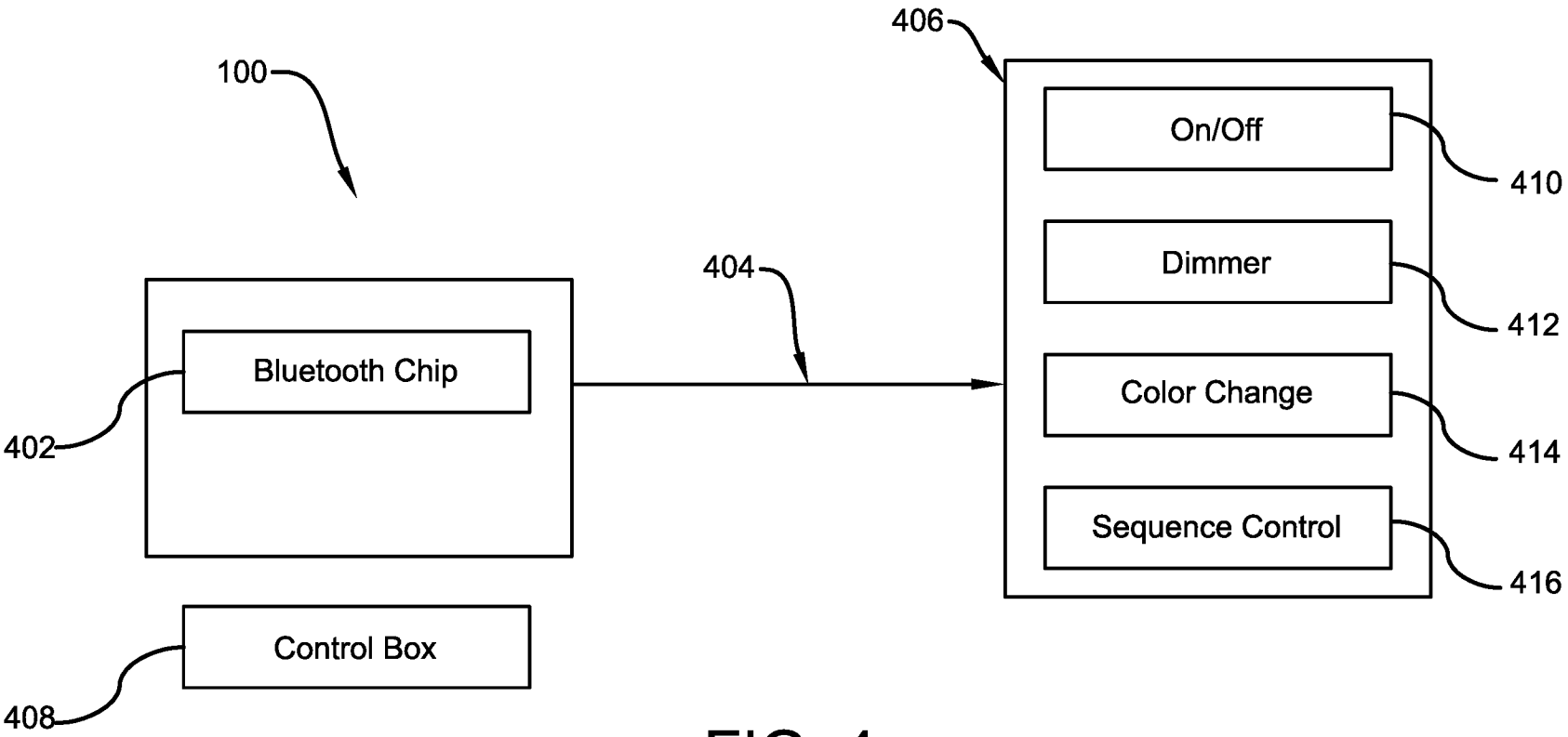
FIG. 4 illustrates a perspective view showing the ability to remotely control one potential embodiment of the decorative light panel of the present invention using a remote control and a wireless medium in accordance with the disclosed architecture.
Figure 5:
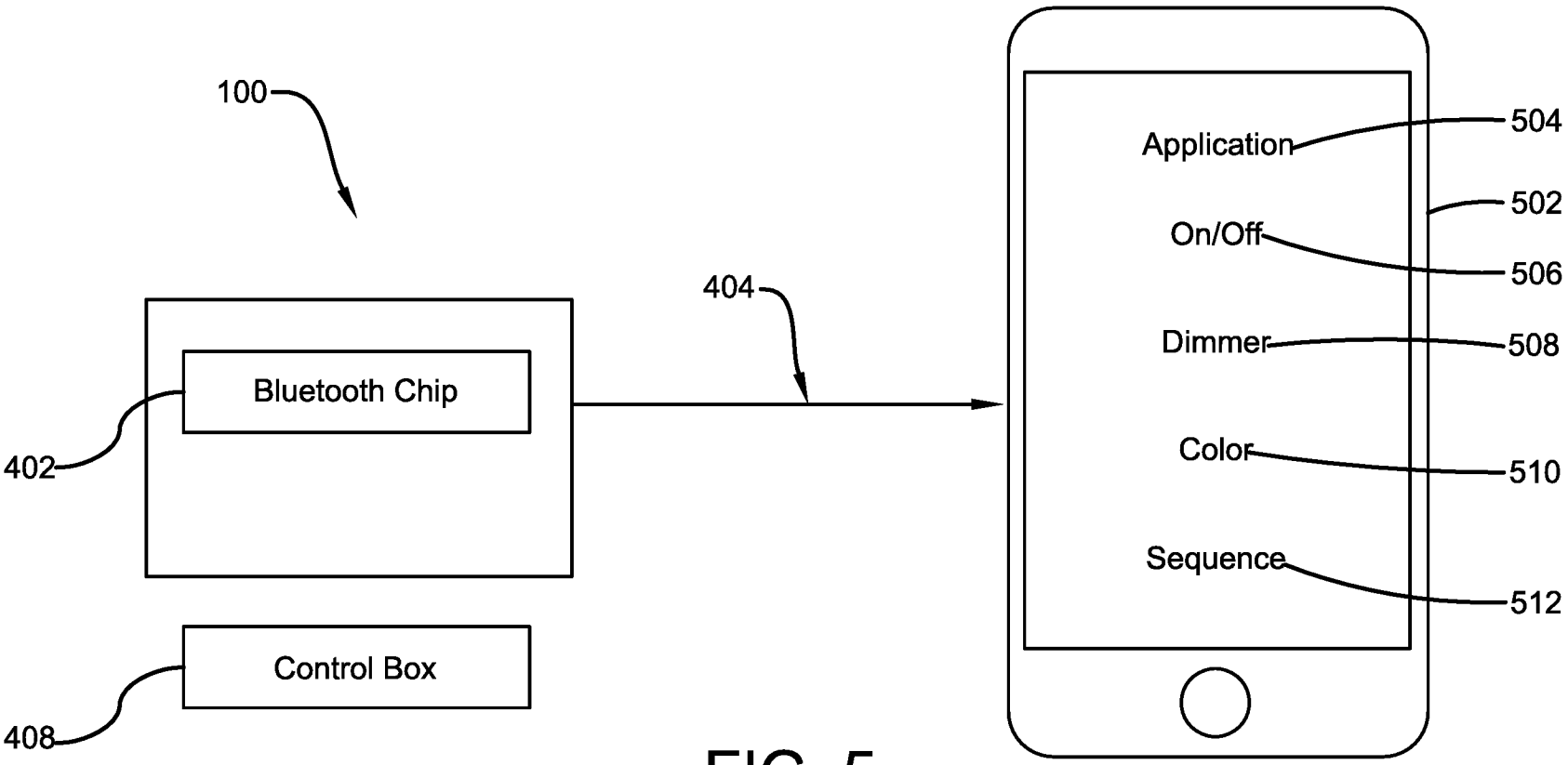
FIG. 5 illustrates a perspective view showing the ability to remotely control one potential embodiment of the decorative light panel of the present invention using a handheld electronic device having an installed software application in accordance with the disclosed architecture.

The upper portion 1042 of the front surface 104 has a plurality of holes 124 for mounting the frame 102 to a mounting surface, such as an exterior surface of a house, using any suitable mechanical fastener as is known in the art. Further, the top portion 1042 extends out to protect the illumination sources 110 disposed in the grooving panel 108 from rain, hailstorm, sleet, etc. In one embodiment, the illumination sources 110 can have a transparent sheet to protect them from inclement weather and physical damage. Further, the housing 102 is paintable, such that it can be matched to the color of a building to which the lighting fixture 100 is mounted. Further, the housing 102 can have any design and shape to securely fit to an exterior of any building. For activating and deactivating the light source 110 of the panel 100, a power button 126 is disposed on the front surface 104. Alternatively, the light sources 110 can be operated remotely using a remote control or a smartphone as shown in FIGS. 4-5.

Depending on the capabilities of the illumination source 110 and driver circuit 122, the decorative lighting panel 100 transmits light therefrom according to specific luminance values. In one embodiment, the luminance parameter of light transmitted from the panel 100 is between about 1,000 lm/m to about 1,200 lm/m, or between about 1,200 lm/m to about 1,800 lm/m. The panel 100 comes in various sizes and shapes and can be oriented in either a horizontal or vertical manner.

It should be appreciated that the lighting panel 100 has an extremely thin form factor, allowing the panel 100 to be easily mounted to any flat surface, such as the exterior wall of a building or the like.

FIG. 2 illustrates a perspective view showing the retractable plastic cover of the decorative lighting panel 100 for covering the illumination sources 110. The advantage of the lighting panel 100 of the present invention is that the illumination sources 110 can be selectively revealed by pulling a retractable plastic cover 202 to the lower portion 1040 of the front surface 104. The lower portion 1040 of the front surface 104 has a slot 204 for accommodating the retractable plastic cover 202, to reveal the illumination sources 110. The control buttons 112, 114 on the lower portion 1040 are coupled to the cover 202 and are configured to operate the cover 202. The buttons 112, 114 on operation, can also push the retractable cover 202 upwards from the slot 204 to abut to the protruding wall 206 of the upper portion 1042 of the front surface 104, thereby allowing the plastic cover 202 to cover the LED panel 110 disposed on the grooving panel 108.

The cover 202 is rolled into the lower portion 1040 to reveal the light panel 110 during operation of the light panel 110. Additionally, the cover 202 is designed to cover the lights when the panel 100 is not used for illumination, such as during non-festival or holiday days or during daytime. Here, the cover 202 is moved upwards from the slot 204 to abut the protruding wall 206.

Figure 3:
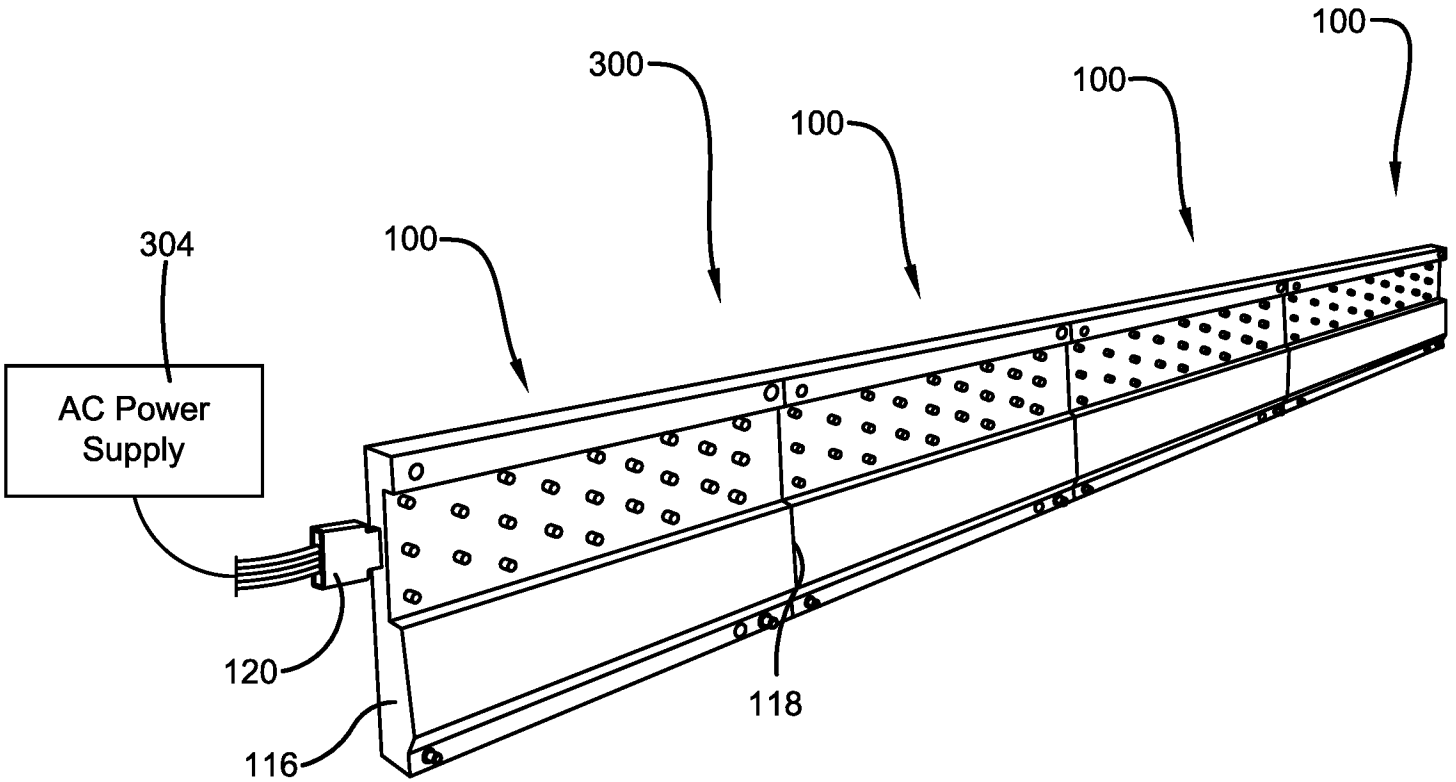
FIG. 3 illustrates a perspective view showing a plurality of one potential embodiment of the decorative lighting panels of the present invention connected to one another to be used in series when installed on a home's exterior in accordance with the disclosed architecture.

FIG. 3 illustrates a perspective view showing a plurality of decorative lighting panels 100 connected to each other to be used in series when installed on a home's exterior. An advantage of the decorative lighting panel 100 of the present invention is that these panels can be stacked together in a series connection 300 to form a permanently installed seasonal light display for mounting on an exterior of a building. Each panel 100 has electrical connectors for connection to other panels and to an external AC supply 304. As shown, each panel 100 has a male connector 120 on the first side edge 116 and a female connector 302 on the second side edge 118. However, in differing embodiments of the device 100 the connectors 120, 302 may be present on any portion/surface of the device 100 such that multiple devices 100 can be arranged and connected to one another in a vertical, horizontal, diagonal, or other orientation/configuration. The male connector 120 of a first panel is connected to the female connector 302 of the other subsequent panel. In a similar way, each panel is attached to the subsequent panel for forming a series of lighting panels. Based on the size of the exterior of a building, any number of panels can be stacked to each other using a driver circuit for the panels, thus a desired lighting sequence can be selected. Further, based on the preferences of users, the LED lights of the selected panels can be revealed by pulling down the retractable plastic cover of the individual decorative lighting panel. When a series of the panels are stacked together, one or both of the lighting panels can be connected to an external power supply, such as a conventional AC power supply 304 that can be converted into a DC power supply by the driver circuit of the panel. The presence of electrical connectors on each end of each panel enables multiple panels to be mounted end to end for creating a long segment of lights.

FIG. 4 illustrates a perspective view showing remote control 406 of the decorative light panel 100 of the present invention using a remote control through a wireless medium. The lighting panel 100 has an integrated Bluetooth chip 402 that enables the panel 100 to establish a Bluetooth wireless channel 404 with a remote control 406. The remote control 406 can be commercially available with the lighting panel 100. The remote control 406 comprises a plurality of control buttons to change the color, intensity, as well as activating or deactivating the panel 100. The Bluetooth chip 402 can be disposed in the driver circuit 122 or may be disposed separately in a control box 408. Specifically, the remote control 406 has an On/Off control button 410 for remotely activating and deactivating the LED sources 110 of the panel 100. A dimmer control button 412 enables a user to dim the LED sources 110 for creating a lighting effect. A color change control button 414 is configured to change the color of the LED sources 110 of the panel. In the preferred embodiment, the LED source 110 is a multi-color LED light that can be configured to emit a particular color. A lighting sequence control button 416 on the remote control 406 enables a user to set a specific lighting sequence for the panel 100. The lighting sequence control button 416 can be pressed to set a specific sequence and can be pressed again to change the sequence of the lighting. When any of the aforementioned control buttons are pressed on the remote control, a corresponding wireless instruction is received by the driver or control box of the panel 100 and thus controls the LED sources 110 accordingly.

When a plurality of decorative panels 100 are stacked together in a manner as explained in FIG. 3, then a single remote control 406 can control all the panels simultaneously in a single instruction. When the lighting panels 100 are stacked, the drivers or control boxes of all the panels are synced and act in a similar way to an instruction received from the wireless remote 406. In addition to Bluetooth, any other suitable wireless communication technology, such as Infrared, RF communication, Wi-Fi, etc., can be used for remotely controlling the panel 100.

FIG. 5 illustrates a perspective view showing remote control of the decorative light panel 100 of the present invention using a handheld electronic device having an installed software application. The lighting panel 100 having the integrated Bluetooth chip 402 can be controlled remotely via a wireless channel 404 created using a handheld electronic device 502, such as a smartphone, tablet, laptop, etc., or any other suitable electronic device as is known in the art. The handheld electronic device 502 has an installed compatible software application 504 that can be downloaded from an application store and is compatible with the lighting panel 100. The compatible software application 504 provides a plurality of control buttons to change the color, intensity, as well as activating or deactivating the panel 100. The electronic device 502, with the installed application 504, acts in a similar manner as the remote control 406 of FIG. 4 and provides control icons for controlling the panel 100. Specifically, the software application 504 provides an On/Off control icon 506 for remotely activating and deactivating the LED sources 110 of the panel 100. A dimmer control icon 508 enables a user to dim the LED sources 110 for creating a lighting effect. A color change control icon 510 is configured to change the color of the LED sources 110 of the panel. A lighting sequence control icon 512 on the software application 504 enables a user to set a specific lighting sequence for the panel 100.

In any of the configurations discussed herein, it is contemplated that the panel 100 can also be controlled using the control box 408. The control box can be a physical component associated with the panel light 100 in the form of a control box disposed in a wall, ceiling, etc., or any other suitable place.

Figure 6:
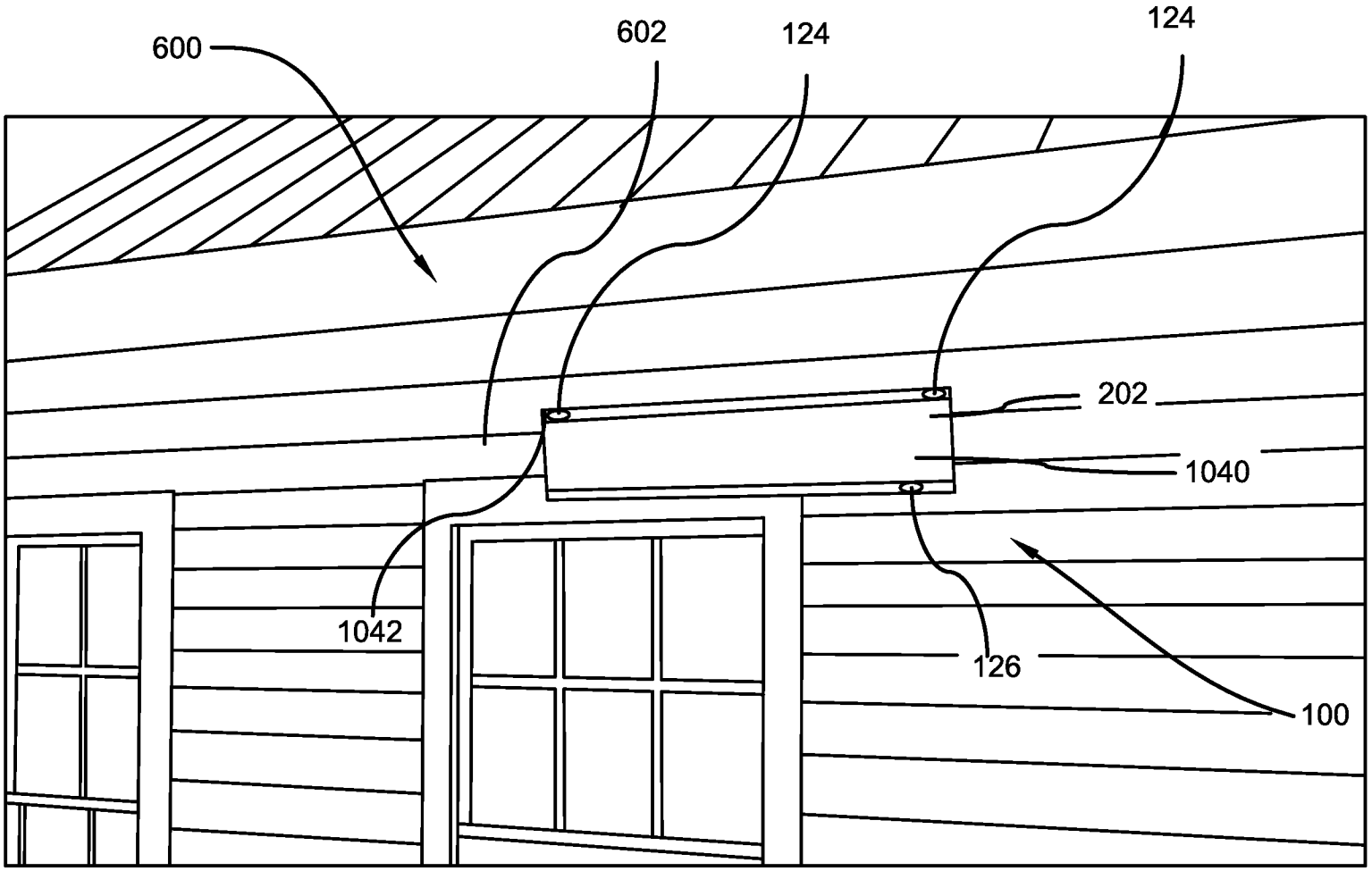
FIG. 6 illustrates a perspective view showing one potential embodiment of the decorative lighting panel of the present invention mounted to a wall of a house in accordance with the disclosed architecture.

FIG. 6 illustrates a perspective view showing the decorative lighting panel 100 of the present invention mounted to a wall of a house. The lighting panel 100 is a flat panel with a weatherproof housing 102 that can be easily mounted to a wall 602 of a house or any building 600. The housing 102 is mounted to the wall 602 using mechanical fasteners, such as brackets, bolts, etc., in the mounting holes 124. When the housing 102 is mounted, the front surface including the lower portion 1040 and the upper portion 1042 are visible from outside, while the retractable plastic cover 202 covers the illumination sources. The power button 126 is accessible to the users for manual control of the illumination sources. For revealing the lights, the cover 202 can be retracted and store in the slot of the lower portion 1040 as described in FIG. 2.

In one embodiment, the panel 100 may come with a mounting channel (not shown). The mounting channel can be available in various lengths and the lighting panels of the present invention can be mounted on the channel, wherein the channel is secured to the wall of a building. The panels can be mounted in the form of a rail by sliding each panel 100 on the mounting channel.

Figure 7:
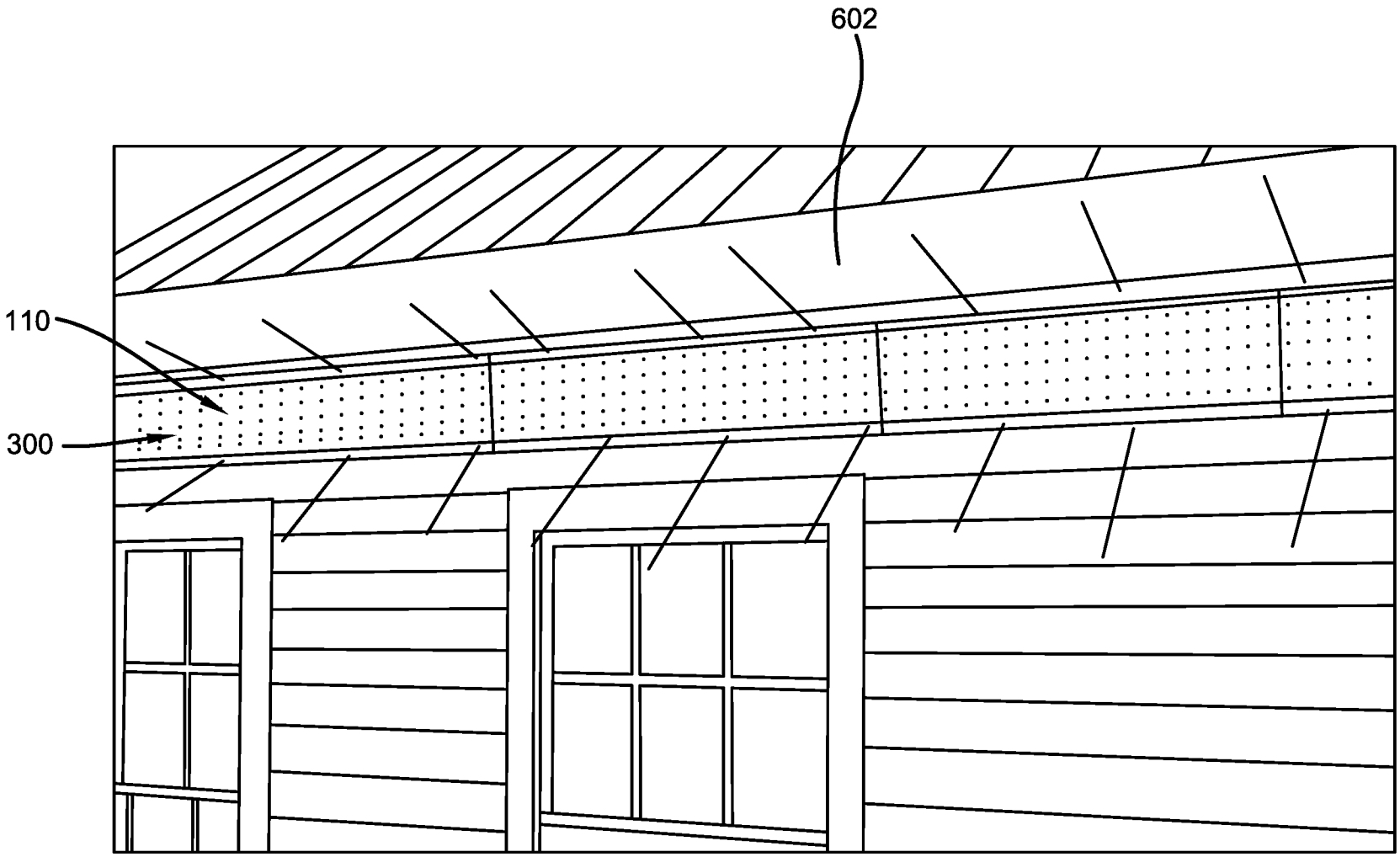
FIG. 7 illustrates a perspective view showing a stack of one potential embodiment of the decorative lighting panels of the present invention installed side-by-side on a wall of the house to be maintained year-round in accordance with the disclosed architecture.

FIG. 7 illustrates a perspective view showing a stack of panels installed side-by-side on a wall of the house to be maintained year-round for different occasions. As shown, for illuminating the building 602 for occasions such as, Christmas, Halloween, birthdays, etc., and numerous other suitable special occasions as is known in the art, a plurality of panels 100 can be connected to each other to form a stack 300. The stack 300 illuminates the building 602 as desired by users and the lighting sequence and pattern can be changed remotely using the remote control or electronic device. Thus, the illumination sources 110 can be selectively revealed and illuminated to create a unique lighting pattern.

Figure 8:
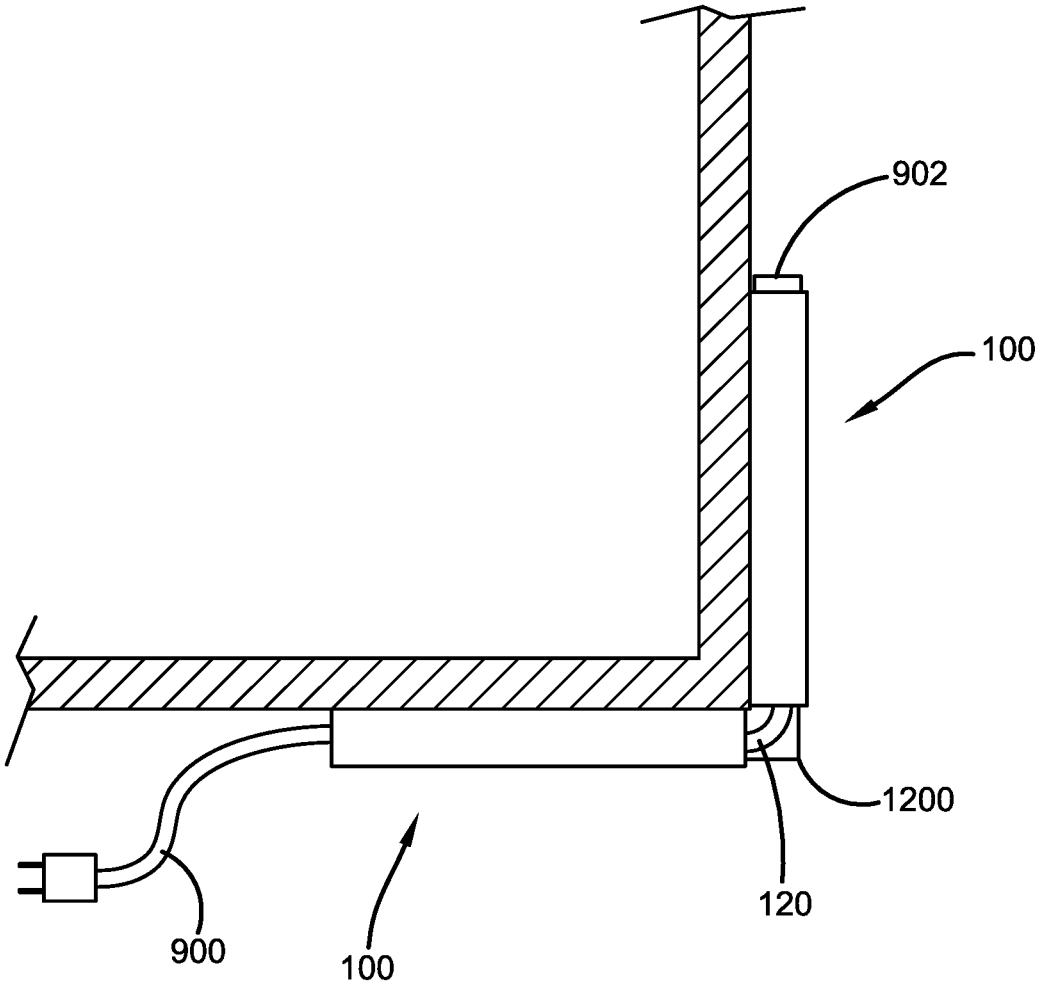
FIG. 8 illustrates a top view of one potential embodiment of the decorative lighting panel of the present invention in accordance with the disclosed architecture.

FIG. 8 illustrates a top view of one potential embodiment of the decorative lighting panel of the present invention in accordance with the disclosed architecture. In one embodiment, multiple panels 100 can be connected to one another while forming a generally 90-degree angle. In this manner, several panels 100 can be placed on numerous adjacent sides of a structure. In this embodiment, the electrical connector 120 may also be at a generally 90-degree angle, allow multiple panels 100 to connect. This is embodiment, the connector 120 may also have a cover 1200 that matches the appearance of the panels 100 and conceals the connector 120 from view. Further, any embodiment of the device 100 may have a power cord 900 of any length that supplies power to the device 100 and can be plugged into a traditional 120V/240V power outlet. Further, the device 100 may have a female adapter 902 located on the device 100 that allows a male 120V/240V power cord to be plugged into the adapter 902 and supply power to the device 100.

In one embodiment of the present invention, the illumination sources of the panel 100 are automatically turned off when the retractable plastic cover is pulled up to cover the illumination sources. This provides the advantage of saving electrical power in cases where a user covers the lights but forgets to turn off the LED lights. Similarly, when the plastic cover is pulled down to reveal the LED lights, then, the LED lights are automatically turned on.

In various embodiments of the present invention, for providing sequencing of the illumination sources/LED lights 110, the panel 100 can have IC-4017 or IC-555. The IC 555 timer generates an astable multivibrator or low-frequency oscillator.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "decorative lighting panel", "lighting panel", "lighting fixture", "panel", "device" and "decorative panel" are interchangeable and refer to the decorative lighting panel 100 of the present invention.

Notwithstanding the forgoing, the decorative lighting panel 100 of the present invention can be of any suitable size and configuration as is known in the art without affecting the overall concept of the invention, provided that it accomplishes the above stated objectives. One of ordinary skill in the art will appreciate that the size, configuration, and material of the decorative lighting panel 100 as shown in FIGS. 1-7 is for illustrative purposes only, and that many other sizes and shapes of the decorative lighting panel 100 are well within the scope of the present disclosure. Although the dimensions of the decorative lighting panel 100 are important design parameters for user convenience, the decorative lighting panel 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A decorative lighting panel configured to be mounted on a home exterior for maintaining decorative lights year-round, the decorative lighting panel comprising:

a housing frame comprising a front surface, a rear surface, a first side edge and a second side edge, wherein the front surface comprises a lower portion and an upper portion;

a groove panel positioned between the front surface and the rear surface and comprising a plurality of illumination sources;

a retractable cover for protecting the plurality of illumination sources, wherein the retractable cover is comprised of a plastic and is controlled via control buttons disposed on the lower portion of the front surface, which are coupled to the retractable cover; and a power button disposed on the front surface for activating and deactivating the plurality of illumination sources, wherein the upper portion comprises a plurality of holes which accept a plurality of mechanical fasteners for mounting the housing frame to a surface, and further wherein the upper portion comprises a protruding wall for protecting the plurality of illumination sources from inclement weather.

2. The decorative lighting panel of claim 1, wherein the lower portion of the front surface comprises a slot for housing the retractable cover when retracted to reveal the plurality of illumination sources.

3. The decorative lighting panel of claim 2, wherein when the retractable cover is released, the retractable cover extends upwards from the slot to abut the protruding wall of the upper portion of the front surface to cover the plurality of illumination sources.

4. The decorative lighting panel of claim 3, wherein the first side edge comprises an electrical male connector that allows connection with a second decorative lighting panel or with an external power supply for illumination.

5. The decorative lighting panel of claim 4, wherein the electrical male connector is internally connected to a driver circuit that drives the plurality of illumination sources.

6. The decorative lighting panel of claim 5, wherein the driver circuit is an LED driver and is connected to the plurality of illumination sources through an internal wired circuit and provides electrical power to the plurality of illumination sources via being electrically coupled to an external AC power supply.

7. The decorative lighting panel of claim 6, wherein the second side edge comprises an electrical female connector for connecting to the electrical male connector of the first side edge, thus a second decorative lighting panel can be connected via the electrical female connector to the electrical male connector of a first decorative lighting panel to create a series connection.

8. A decorative lighting panel configured to be mounted on a home exterior for maintaining decorative lights year-round, the decorative lighting panel comprising:

a housing frame comprising a front surface with a lower portion and an upper portion, a rear surface, a first side edge, and a second side edge;

a groove panel positioned between the front surface and the rear surface and comprising a plurality of illumination sources;

a retractable cover for protecting the plurality of illumination sources;

wherein the upper portion comprises a plurality of holes which accept a plurality of mechanical fasteners for mounting the housing frame to a surface;

wherein the upper portion comprises a protruding wall for protecting the plurality of illumination sources from weather;

wherein the lower portion of the front surface comprises a slot for housing the retractable cover when retracted, to reveal the plurality of illumination sources;

wherein when the retractable cover is released, the retractable cover extends upwards from the slot to abut the protruding wall of the upper portion of the front surface, to cover the plurality of illumination sources;

a power button disposed on the front surface for activating and deactivating the plurality of illumination sources; and an integrated Bluetooth chip that establishes a Bluetooth wireless channel with a remote control, wherein the first side edge comprises an electrical male connector that allows connection with a second decorative lighting panel or with an external power supply for illumination, and further wherein the second side edge comprises an electrical female connector for connecting to the electrical male connector of the first side edge.

9. The decorative lighting panel of claim 8, wherein the remote control comprises a plurality of control buttons.

10. The decorative lighting panel of claim 9, wherein the plurality of control buttons comprise an on/off control button, a dimmer control button, a color change control button and a lighting sequence control button.

11. The decorative lighting panel of claim 10, wherein a second decorative lighting panel can be connected via the electrical female connector to the electrical male connector of a first decorative lighting panel to create a series connection between the first and the second decorative lighting panel.

12. A decorative lighting panel configured to be mounted on a home exterior for maintaining decorative lights year-round, the decorative lighting panel comprising:

a housing frame comprising a front surface with a lower portion and an upper portion, a rear surface, a first side edge, and a second side edge;

a groove panel positioned between the front surface and the rear surface and comprising a plurality of illumination sources;

a retractable cover for protecting the plurality of illumination sources;

wherein the upper portion comprises a plurality of holes which accept a plurality of mechanical fasteners for mounting the housing frame to a surface;

wherein the upper portion comprises a protruding wall for protecting the plurality of illumination sources from weather;

wherein the lower portion of the front surface comprises a slot for housing the retractable cover when retracted, to reveal the plurality of illumination sources;

wherein when the retractable cover is released, the retractable cover extends upwards from the slot to abut the protruding wall of the upper portion of the front surface, to cover the plurality of illumination sources;

a power button disposed on the front surface for activating and deactivating the plurality of illumination sources; and an integrated Bluetooth chip that establishes a Bluetooth wireless channel with a handheld electronic device that has an installed compatible software application, wherein the first side edge comprises an electrical male connector that allows connection with a second decorative lighting panel or with an external power supply for illumination, and further wherein the second side edge comprises an electrical female connector for connecting to the electrical male connector of the first side edge.

13. The decorative lighting panel of claim 12 wherein the compatible software application provides a plurality of control buttons, such as an on/off control icon, a dimmer control icon, a color change control icon and a lighting sequence control icon.

14. The decorative lighting panel of claim 12 wherein the decorative lighting panel can be controlled via an associated control box disposed on a surface.

* * * * *